US010246237B2

(12) United States Patent
Popkin

(10) Patent No.: US 10,246,237 B2
(45) Date of Patent: Apr. 2, 2019

(54) MULTI-CAVITY BLISTER PACKAGE WITH INDIVIDUALLY ACCESSIBLE PRODUCT WINDOWS

(71) Applicant: Jeffrey Popkin, Weston, FL (US)

(72) Inventor: Jeffrey Popkin, Weston, FL (US)

( * ) Notice: Subject to any disclaimer, the term of this patent is extended or adjusted under 35 U.S.C. 154(b) by 28 days.

(21) Appl. No.: 15/375,285

(22) Filed: Dec. 12, 2016

(65) Prior Publication Data

US 2018/0162617 A1 Jun. 14, 2018

(51) Int. Cl.
*B65D 75/36* (2006.01)
*B65D 75/56* (2006.01)
*B65D 75/58* (2006.01)

(52) U.S. Cl.
CPC ..... *B65D 75/367* (2013.01); *B65D 75/566* (2013.01); *B65D 75/5833* (2013.01); *B65D 2575/3227* (2013.01); *B65D 2575/586* (2013.01)

(58) Field of Classification Search
CPC .. B42D 5/047; B65D 73/0035; B65D 73/005; B65D 75/327; B65D 75/3677; B65D 75/58; B65D 75/5833; B65D 75/566; B65D 2575/3227; B65D 75/36
See application file for complete search history.

(56) References Cited

U.S. PATENT DOCUMENTS 6,131,737 A * 10/2000 Marshall ..... B65D 75/36 206/348
D449,780 S 10/2001 Corella
9,422,101 B2 8/2016 Wu et al.
9,764,886 B2 * 9/2017 Bow ..... B65D 75/326
2003/0116459 A1 * 6/2003 Sarkar ..... B65D 75/36 206/362.1
2003/0163936 A1 * 9/2003 Floss ..... B42D 5/04 40/107
2004/0245145 A1 * 12/2004 Urban ..... B65D 75/36 206/531
2006/0231447 A1 * 10/2006 Fensham ..... B65D 75/36 206/471
2009/0184023 A1 * 7/2009 Brollier ..... A61J 1/035 206/531
2013/0015095 A1 * 1/2013 Carson ..... A61J 1/035 206/533
2013/0299499 A1 * 11/2013 Elliott ..... B65D 75/327 220/359.1
2014/0326634 A1 * 11/2014 Milante ..... A61J 1/035 206/531

(Continued)

FOREIGN PATENT DOCUMENTS

GB 1223262 A * 2/1971 ..... B65D 75/36

*Primary Examiner* — Mollie Impink
(74) *Attorney, Agent, or Firm* — Myron Greenspan; Lackenbach Siegel LLP

(57) ABSTRACT

A multi-cavity blister package includes a backing card. A transparent, plastic semi-rigid cover sheet co-extensive with the backing card formed with a plurality of raised portions each of which, when secured to the backing card, forms a product receiving cavity or compartment. The plastic covering is secured to the backing card to form a plurality of product receiving cavities. The backing card has perforations proximate to each product-receiving cavity to allow selective perforations to be burst to provide access to an associated cavity without compromising remaining cavities or compartments for future use.

13 Claims, 5 Drawing Sheets

(56) References Cited

U.S. PATENT DOCUMENTS

| | | | | |
|---|---|---|---|---|
| 2015/0096920 | A1* | 4/2015 | Trombley | B65D 75/36<br>206/531 |
| 2016/0251131 | A1* | 9/2016 | Edwards | B65B 3/04<br>206/524.7 |

* cited by examiner

MULTI-CAVITY BLISTER PACKAGE WITH INDIVIDUALLY ACCESSIBLE PRODUCT WINDOWS

BACKGROUND OF THE INVENTION

1. Field of the Invention

The present invention is generally directed to blister packages and, more specifically, to a multi-cavity blister package with individually accessible perforated product windows.

2. Description of the Related Art

Blister packages or blister packs are well known pre-formed plastic packaging used for small consumer goods, foods and pharmaceuticals. More specifically, blister packs are formed with cavities pouches, chambers, pockets or compartments made from a thermo-formed transparent plastic sheet typically attached to a backing card of paper board. Blister packs are commonly used for packaging toys, hardware and electrical items captured between the paper board card and the clear pre-formed plastic, such as PVC, to allow consumers to visually examine the product through the transparent plastic. The plastic is vacuum-formed to form raised blisters, windows or projections generally shaped to conform to the shape of the product that is being displayed. The pre-formed plastic sheet is normally affixed to the card by using heat and pressure to activate an adhesive on the blister card. The blister pack is sufficiently rigid and strong to hang on a peg of a display, but, theoretically, weak enough so that the package can be opened with relative ease. The backing cards are frequently provided with perforations that define tabs, strips or flaps in on the back of the plastic covering sheet that can be burst open along a perforation to allow access to the compartment or cavity containing the product to allow removal thereof from the package. It is not uncommon for such blister packs to be rather difficult to open along the perforations and other means, such as a knife or scissors, have frequently been used to cut the package open by scoring or cutting the card along the perforations.

A problem that has commonly existed with blister packs is that a pre-formed plastic pouch or cavity is configured to contain a plurality of like products, such as pens, batteries, etc. Although these items are secure as long as the tabs, strip or flap on the back of the package remain unopened once the perforations are severed to access a single or multiple items, the package remains open and there is no good way to close the package still containing any remaining product(s). Sometimes measures have been taken by consumers to try to re-seal the package as best they can, to prevent the remaining product(s) from inadvertently falling out and being misplaced, such as by using rubber bands or adhesive tape to close or "re-seal" the package with partial contents therein. This is both an inconvenience and is not a suitable or reliable solution since rubber bands become dry and brittle and rupture and tape can also dry out and lose adhesion, so that such make shift solutions are at best, temporary.

U.S. Pat. No. 9,422,101 discloses a blister package with multiple compartments, an outer blister and an inner blister are shown to cooperate with each other, each blister portion having a flange and access is provided to compartments within the inner blister portion by rotation of the outer blister. This is a relatively complex construction, more expensive to manufacture and more difficult and inconvenient to use.

U.S. Pat. No. D449,780 discloses a two compartment blister package. Although there are two pre-formed pouches or cavities formed on the paperboard card, once the "single use" package is opened that opens both cavities as the contents of both cavities are intended to be removed and used together. Where products in adjacent cavities are intended to cooperate with each other and both must be used together this does not present a problem since the products in both cavities must be removed and used so no products remain on the card. However, where the same or similar products are contained in package only one or a few of which need to be used and the remaining products or items need to be saved for future use the illustrated blister package cannot satisfy that function.

SUMMARY OF THE INVENTION

In order to overcome the problems of prior art blister packages containing a plurality of the same or like products only one or a few of which need to be used an object of the invention to provide a multi-cavity blister package that can store a plurality of the same or like items only one or a few of which may be removed while the remaining products can continue to be stored in unaltered and uncompromised cavity compartments on the package.

It is another object of the invention to provide a multi-cavity blister package as described in the previous object that is simple in construction and economical to manufacture.

It is yet another object of the invention to provide a multi-cavity blister package as in the previous objects which is easy and convenient to use by consumers.

It is still a further object of the invention to provide a multi-cavity blister package the type under discussion that can be used to store an array of the same or like products with as few as two product chambers or cavities to as many as are desired to populate the surface area on a single blister card.

It is a further object of the invention to provide a multi-cavity blister package that facilitates multiple uses of a blister package by providing individually accessible product pouches, blisters, cavities or compartments by opening individual cavities or compartments bursting perforations provided on a flat backing card adjacent or in back of each of the cavities or compartments.

It is still a further object of the invention to provide a multi-cavity blister package with individually accessible windows and perforations that are designed to minimize or reduce bursting forces required to open the individual cavities along associated perforations.

It is yet a further object of the invention to provide a multi-cavity blister package that allows a consumer to use as few as one or a few of a plurality of products individually stored or contained within cavities, compartments or pouches of a blister package without disturbing the remaining products to thereby ensure the continued integrity and security of the remaining products for future use.

In order to achieve the above objects, as well as others that will become evident hereinafter, a multi-cavity blister package consists of a generally flat backing card having a pre-defined surface area. A transparent, generally flat plastic semi-rigid cover sheet is generally co-extensive with the backing card over the pre-determined area, the plastic cover sheet being provided with a plurality of pre-formed raised portions each of which, when secured to the backing card, forms a product receiving cavity, pouch or compartment. Selected portions of the plastic cover sheet is secured to the backing card to form a plurality of product receiving cavities. The backing card is provided with perforations proximate to each product-receiving cavity to allow selective perforations to be burst to provide access to an associated cavity for removal of a product contained therein without compromising those cavities or compartments in which products remain for future use.

BRIEF DESCRIPTION OF THE DRAWINGS

Those skilled in the art will also appreciate the improvements and advantages that derive from the present invention upon reading the following detailed description in conjunction with the Figures in which.

DETAILED DESCRIPTION OF THE PREFERRED EMBODIMENT

Figure 1:
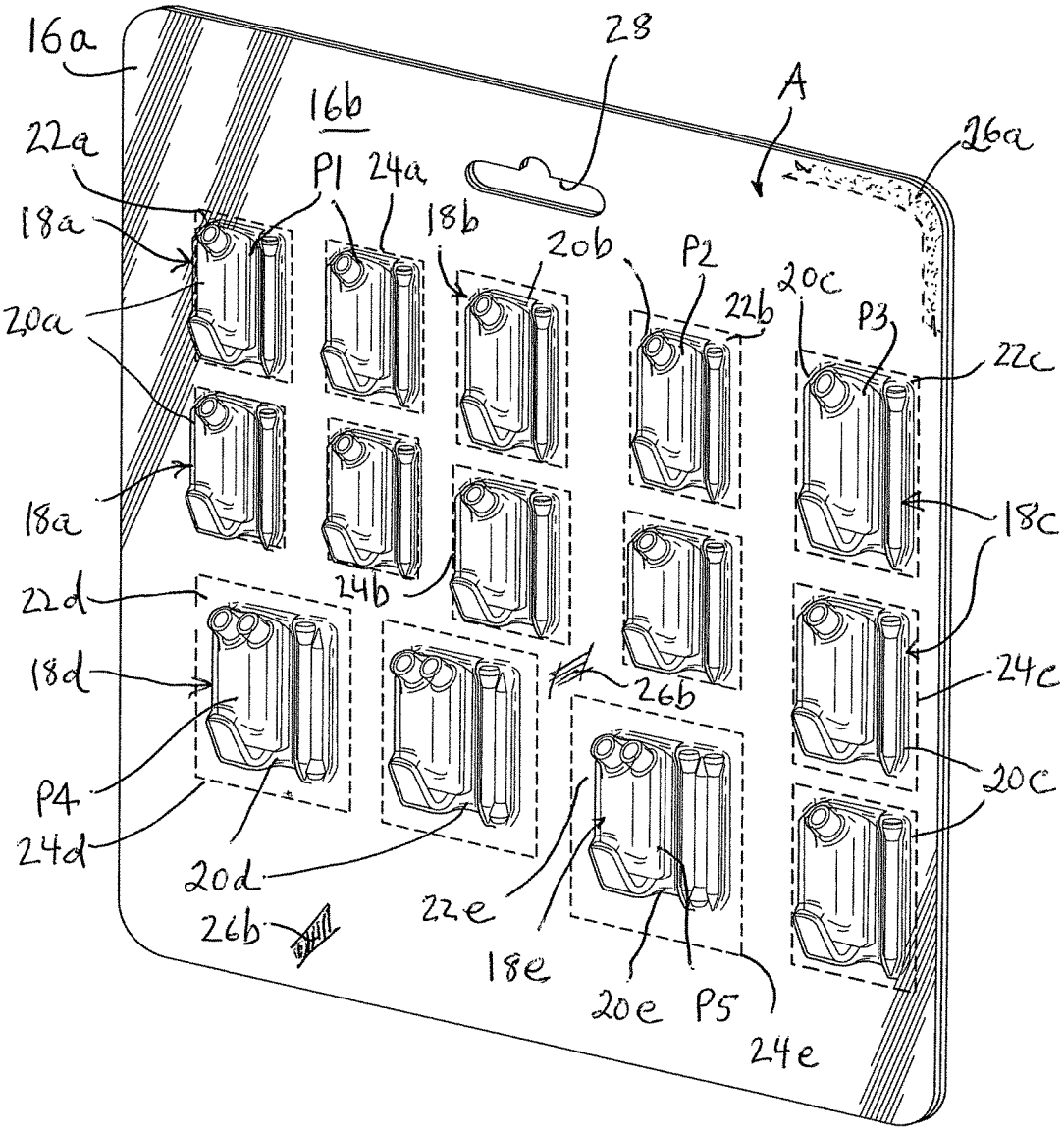
FIG. 1 is a perspective view of a multi-cavity blister package in accordance with the invention forming an array or matrix of cavities, chambers or compartments for storing and displaying same or similar products each individually packaged and accessible on the card.
Figure 2:
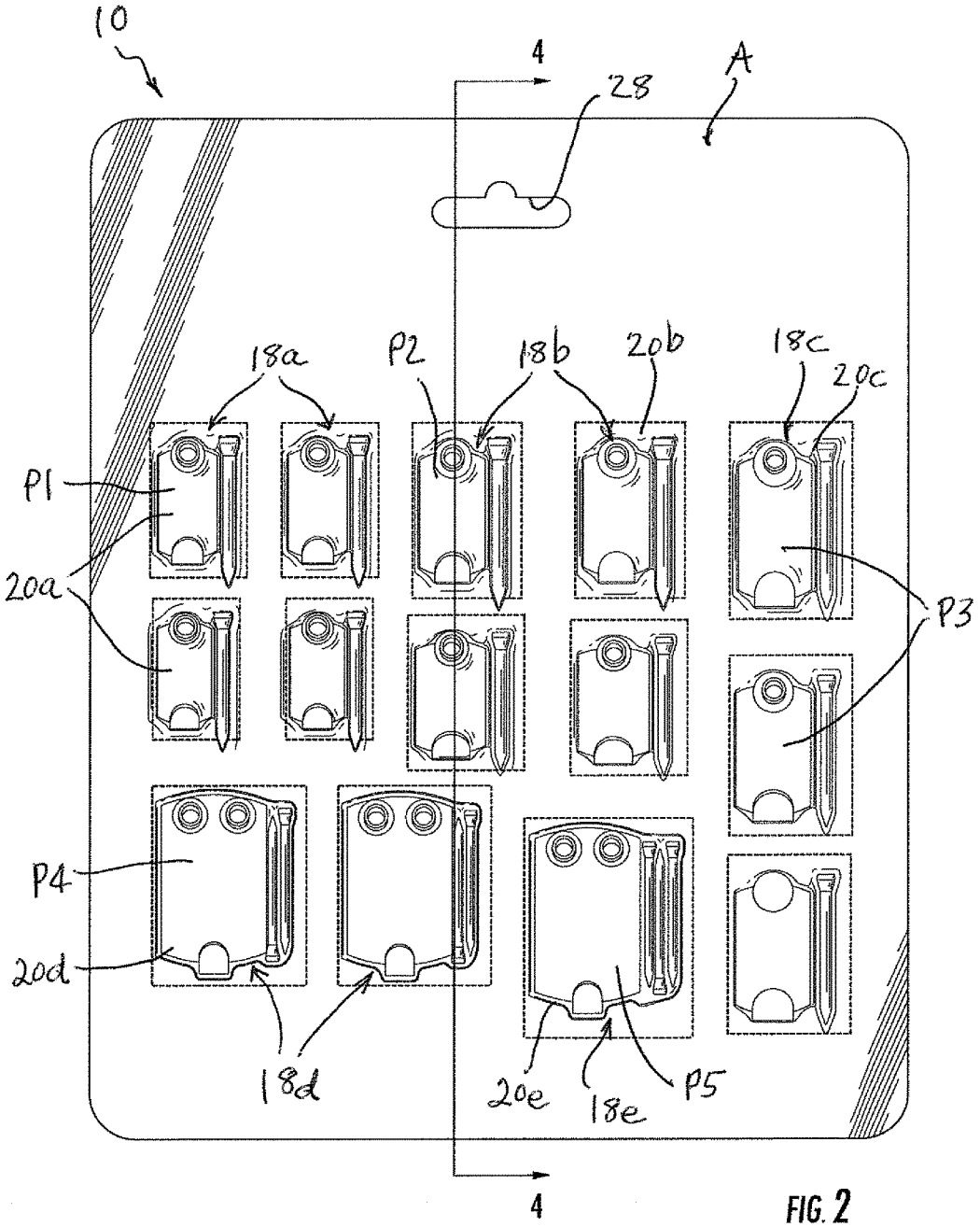
FIG. 2 is a front elevational view of the multi-cavity blister package shown in FIG. 1.
Figure 3:
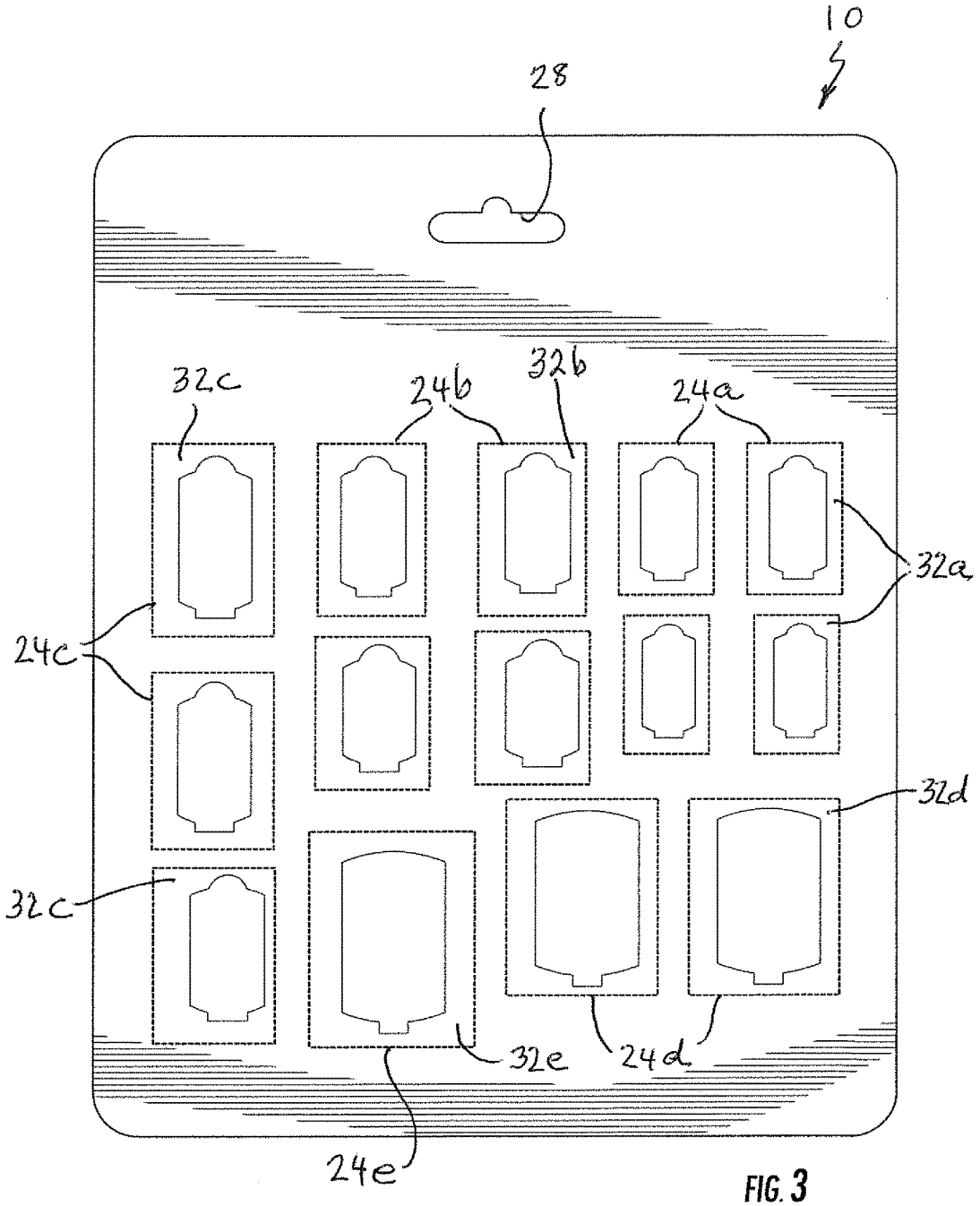
FIG. 3 is a rear elevational view of the package shown in FIG. 2.

Referring now to the Figures, in which the identical or similar parts are designated by the same reference or numerals throughout, and first referring to FIGS. 1-3, a multi-cavity blister pack with individually accessible perforated product windows, cavities or pouches is generally designated by the reference numeral 10.

The blister package 10 is a multi-cavity blister package that includes a generally flat backing card 12 having a predefined surface area A. While the blister package 10 can assume different shapes or outlines and sizes the presently preferred embodiment is rectangular as shown in FIGS. 1 and 2 and the surface area A is equal to the product of the height H of the package and its width W.

A plastic semi-rigid cover sheet 14 is generally coextensive with the backing card 12 and, therefore, also shares the same surface area A. The surface area A includes a peripheral portion 16*a* that extends about the perimeter of the blister package 10, the remaining area being designated by the reference numeral 16*b*.

Figure 4:
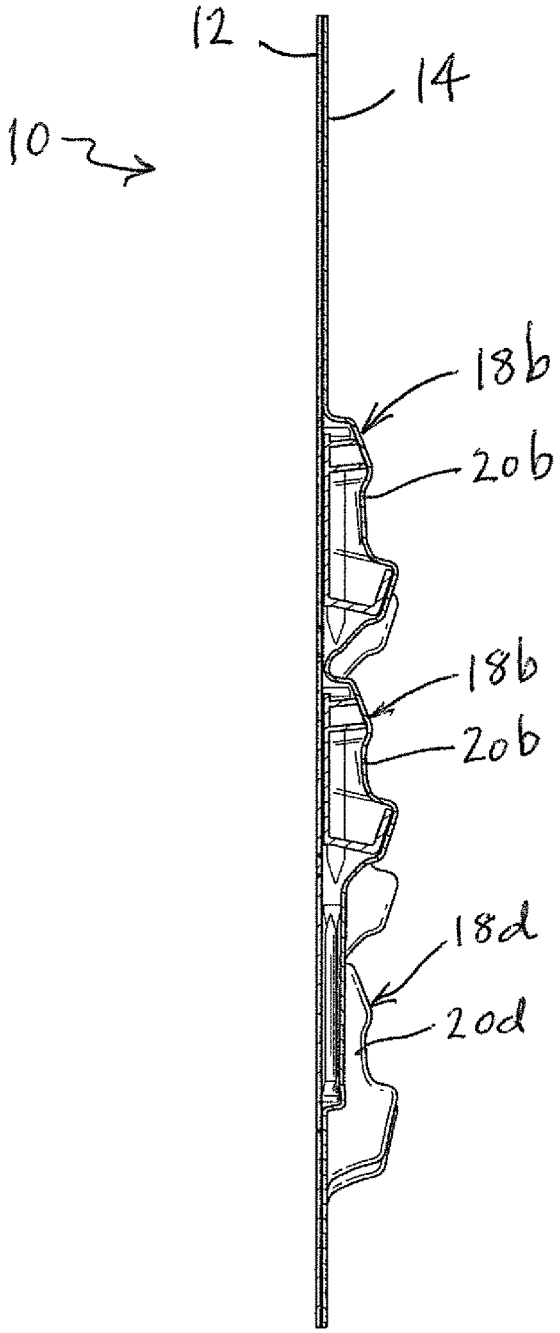
FIG. 4 is a cross sectional view of the blister package shown in FIG. 2, taken along line 4-4.

The plastic cover sheet may be any suitable semi-rigid plastic material conventionally used for making blister packages formed with a plurality of product containing cavities, compartments or chambers 18*a*, 18*b*, 18*c*, 18*d* and 18*e* in the embodiment illustrated. The product receiving cavities may be arranged in an array or matrix of rows and columns, such as three rows and five columns as shown. However, the present invention contemplates any arrangement or number of cavities on the backing card 12 consistent with the sizes of the cavities 18*a*-18*e* necessary to contain and display products P1, P2, P3, P4 and P5. At least two product receiving cavities may be used but there is no limit on the maximum number of such cavities as these will be determined by the size of the backing card 12 and the sizes of the individual cavities 14 required for housing and displaying the products. As illustrated in FIGS. 1 and 2, the cavities 18*a*-18*e* are differently sized to house and display related but different products (e.g. sizes, appearances, etc.). Thus, in the example illustrated, picture hanging hooks are shown with four of the cavities 20*a* housing being smallest and housing a picture hook P1 supported by a single nail, four cavities 20*b* housing a larger picture hook supported by a single nail, three cavities 20*c* housing a still larger picture hook supported by a single nail, two cavities 20*d* housing a larger picture hook supported by two nails and, one cavity 20*e* housing a picture hook supported by three nails. Package 10, therefore, is in the nature of a kit of assorted picture hooks as may be needed by a consumer for differently sized pictures or frames. The plastic cover sheet 14 is thermoformed to create raised windows 20*a*, 20*b*, 20*c*, 20*d* and 20*e* to accommodate products P1-P5 to be stored and displayed in associated compartments or cavities, as also shown in FIG. 4.

A hang hole or cutout 28 may also be provided as is typical with such packages for hanging the packages on a peg of a display or rack.

The cover sheet 14 is typically transparent and secured to the backing card 12 in any conventional manner to form the product compartments, cavities or chambers 18*a*-18*e*. For example, the transparent cover sheet may be secured along the perimeter 16*a* by means of a heat seal 26*a*. Depending on the size of the blister package 10, the plastic covering sheet may also be secured to the backing card 12 in selected regions 26*b* between product receiving cavities over selected portions of the remaining area 16*b*.

The plastic coversheet, as noted, is semi-rigid and typically formed of PVC with a predetermined flexibility to allow a user to apply pressure to the raised window 20*a*-20*e* to apply pressure on the products P1-P5 to apply pressure, in turn, to the backing card 12.

An important feature of the invention is the provision of perforations 24*a* on the backing card 12 proximate to each product-receiving cavity, chamber or compartment 18*a*-18*e* to provide individual access to an associated cavity. In this manner, selected perforations can be burst to provide access to an associated cavity to remove a product therein without compromising the remaining cavities or compartments in which product remains for future use. As indicated in FIG. 1-3, the perforations 24*a* are generally coextensive with associated cavities 18*a*-18*e* to form a closed outline on the backing card 12 that substantially corresponds to the size and shape of an associated cavity 18*a*-18*e*. In the embodiment illustrated the perforations 24*a* are uniform and define a rectangular tab, flap or strip 32 that essentially corresponds to the size and shape of an associated cavity. However, as shown the tabs 32 may be slightly oversized to facilitate opening. The rectangular perforations 24*a* form two opposing sides of equal lengths. In accordance with one embodiment of the invention all of the perforations are of equal lengths and selected to facilitate the bursting open of a tab or strip 32 by application of a suitable pressure by a user on the plastic covering 14 and the enclosed product to then transfer the force to the tab or strip 32.

Selection of the correct perforations determines the bursting strength of the tabs or strips 32. The bursting strength, as is known in the industry, is both a function of the number of teeth per inch (TPI), tie widths (tw) or spaces between the perforations. The force that needs to be applied to the tabs or strips 32 to sever the panel along the perforations is normally termed the "burst strength" and is the amount of pressure needed to rupture a sheet of paper that is perforated. When a backing card is perforated the card is partially cut so that the burst strength is reduced. For any given perforated configuration the burst strength is usually expressed as TPI×tw=percent of hold. By changing these parameters the burst strength can be significantly changed from low to high. For example, 12-16 TPI typically provides intermediate-to-hard tear strength ideal for mailings and other applications that require a lot of handling. Medium to easy tear can be achieved with 8 TPI while 6 TPI and lower normally provides easier tear. However, the burst strength is also a function of numerous other factors besides the TPI and tie widths. Such factors include, for example, grain direction of the card stock, the type of substrate (paper, recycled board, etc.), the density and thickness of the substrate, the age of the paper, temperature and relative humidity that affects the moisture content of the paper and even the bevel of the perforated blade that forms the perforations. Those skilled in the art will know how to select these factors to provide a desired burst strength to provide both security for the products while ensuring accessibility to a selected cavity and the product(s) contained therein without compromising the cavities or compartments in which products remain. The blister package 10, therefore, allows a user to selectively access and use items or products that are needed without disturbing the remaining products contained in the yet unopened cavities for future use.

Figure 5:
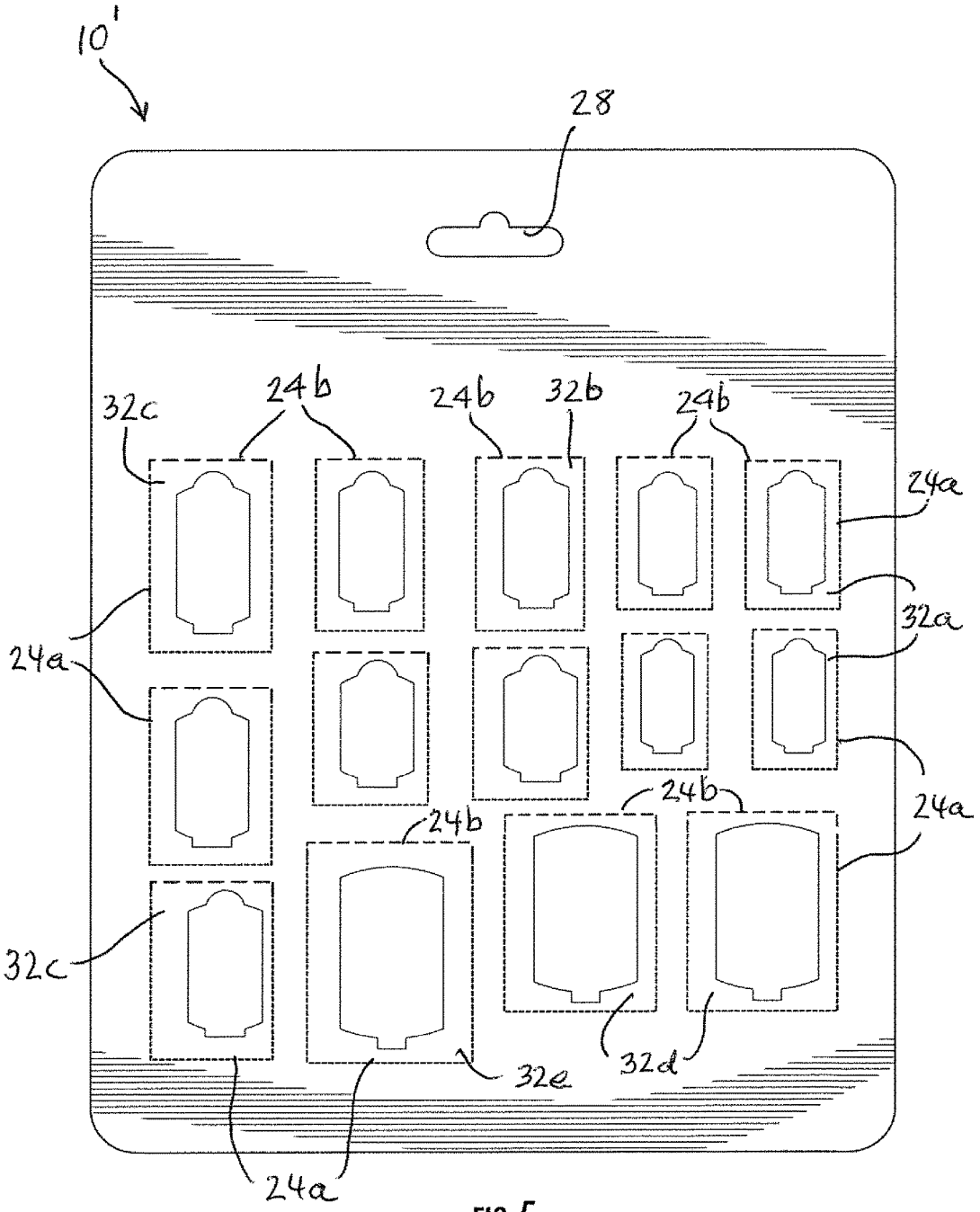
FIG. 5 is a rear elevational view similar to FIG. 3 of an alternate embodiment in which the perforations along the top sides or edges, as viewed in FIG. 5, are modified from the perforations provided along the sides and bottom edges of each window or blister.

Another embodiment of the invention provides different perforation configurations along one or more of the sides of the tabs, strips or flaps 32. Referring to FIG. 5, an alternate embodiment is shown in which the perforations 24*a* have one TPI while the perforations 24*b* at the top of each window have another TPI to modify the burst strength to facilitate the rupturing of the tabs or strips to facilitate tearing of the perforations along at least one of the four sides. This is a useful feature to allow a user to more easily open one or more of the tabs or strips 32 and access selected products without damaging the blister packages so that it can be preserved for future use. Micro perforations can also be used to provide weaker perforations. For example, an 8 TPI×0.032 tw=0.256 or 25.6% hold. Changing the tie to 0.018 inch provides a perforation with a 14.4% hold, substantially less even though it uses the same TPI. A 32 TPI×0.008 tw also has a 25.6% hold so it is essentially the same strength as the 8 TPI even though finer micro perforations are often thought of being weaker than coarse perforations. The tear strength of a 32 TPI, however, is about 25% the tear strength of the 8 TPI×0.032 perforations since the tw is about 25% the size. Stated in another way, the 32 TPI is just as strong (same burst strength) but much easier to tear. Those skilled in the art will be able to select the appropriate parameters for the perforations either about the entire peripheries of the tabs or strips 32 or provide different parameters for the perforations to provide desired bursting strengths for a given blister pack type, size, product etc.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. Multi-cavity product package comprising a plurality of products each product comprises at least two differently shaped components required to perform a predetermined task; a generally flat backing card having predetermined dimensions and a pre-defined surface area; and a transparent plastic semi-rigid cover sheet generally co-extensive with said backing card over said pre-determined surface area, said plastic cover sheet being provided with a plurality of raised portions each of which when secured to said backing card forms a multi-component product receiving blister, cavity, chamber or compartment and each of said raised portions being thermoformed and shaped to conform to at least a portion of the surface of each component and display all of the components of each multi-component product to maintain the components of each of the multi-component products arranged in a plane substantially parallel to said flat backing card in substantially fixed positions so that all the components of each multi-component product are visible prior to removal from a selected blister, cavity, chamber or compartment thereby indicating to a user that all required components for the predetermined task are present in each blister, cavity, chamber or compartment and available to accomplish the predetermined task; means for securing selected portions of said plastic cover sheet to said backing card to form said plurality of said product receiving blisters, cavities, chambers or compartments, said backing card being provided with perforations proximate to each product-receiving blister, cavity, chamber or compartment, whereby selective perforations can be burst to provide access to an associated product receiving blister, cavity, chamber or compartment to remove all the associated components of a multi-component product contained therein without compromising said flat backing card and remaining product receiving blisters, cavities, chambers or compartments or compartments in which remaining multi-component products continue to be fully visible through a transparent raised portion for future use.

2. A multi-cavity product package as defined in claim 1, wherein said product receiving blisters, cavities, chambers or compartments are arranged in an array of rows and columns.

3. A multi-cavity product package as defined in claim 1, wherein at least one of said product receiving blisters, cavities, chambers or compartments differs in size and/or shape to accommodate different products.

4. A multi-cavity product package as defined in claim 1, wherein said at least one of said product receiving blisters, cavities, chambers or compartments differs in size to accommodate similar but different-sized products.

5. A multi-cavity product package as defined in claim 1, wherein said perforations are generally coextensive with associated product receiving blisters, cavities, chambers or compartments.

6. A multi-cavity product package as defined in claim 5, wherein said perforations are equal in length.

7. A multi-cavity product package as defined in claim 5, wherein at least a portion of said perforations are longer perforations to facilitate tearing of said perforations.

8. A multi-cavity product package as defined in claim 5, wherein at least a portion of said perforations is formed by micro perforations.

9. A multi-cavity product package as defined in claim 1, wherein said semi-rigid cover sheet is formed of PVC.

10. A multi-cavity product package as defined in claim 1, wherein said perforations are selected to provide a preselected burst strength for severing said perforations to provide access to an associated product blister, cavity, chamber or compartment.

11. A multi-cavity product package as defined in claim 1, wherein said backing card weight and perforation teeth per inch and tie widths are selected to facilitate tearing of said backing card with a pressure applied against said backing card that is at least equal to a predetermined bursting strength.

12. A multi-cavity product package as defined in claim 1, wherein means for securing comprises a heat seal.

13. A multi-cavity product package as defined in claim 12, wherein said heat seal includes selected regions between product receiving blisters, cavities, chambers or compartments.

* * * * *